US007144359B1

(12) United States Patent
Ponthan et al.

(10) Patent No.: US 7,144,359 B1
(45) Date of Patent: Dec. 5, 2006

(54) METHOD OF RECONFIGURING A FLEXIBLE PLANAR ITEM TO A SIMULATED CHARACTER

(75) Inventors: Mary M. Ponthan, St. Louis Park, MN (US); David P. Behr, Hopkins, MN (US); George R. Larsgard, Bloomington, MN (US)

(73) Assignee: MPA International Corporation, St. Louis Park, MN (US)

( * ) Notice: Subject to any disclaimer, the term of this patent is extended or adjusted under 35 U.S.C. 154(b) by 0 days.

(21) Appl. No.: 09/680,817

(22) Filed: Oct. 5, 2000

(51) Int. Cl.
*B31B 1/26* (2006.01)
*A47G 9/02* (2006.01)
*A63H 3/02* (2006.01)

(52) U.S. Cl. ..... 493/405; 5/482; 446/71; 493/937

(58) Field of Classification Search ..... 5/485, 5/417, 413; 493/955, 937, 231, 243, 254, 493/397, 405; 446/71, 72, 73
See application file for complete search history.

(56) References Cited

U.S. PATENT DOCUMENTS 1,575,263 A * 3/1926 Guglielmi ..... 446/72
1,819,295 A * 8/1931 Holt ..... 446/268
2,406,994 A * 9/1946 Chu et al. ..... 446/268
3,174,253 A * 3/1965 White ..... 446/385
3,789,546 A * 2/1974 Morrison ..... 446/227
4,236,263 A * 12/1980 Allee ..... 2/69.5
4,387,530 A * 6/1983 Miller ..... 446/387
4,458,372 A 7/1984 Mills ..... 5/413
4,590,633 A * 5/1986 Pickens ..... 446/369
4,734,948 A 4/1988 Danova ..... 5/502
4,739,529 A * 4/1988 Mills ..... 2/69.5
4,754,512 A 7/1988 Chao-Yang ..... 5/482
4,774,734 A * 10/1988 Mills ..... 2/69.5
5,093,947 A * 3/1992 Henegar et al. ..... 5/482
5,172,440 A * 12/1992 Ming ..... 5/417
5,287,571 A * 2/1994 Rademacher ..... 190/2
5,421,045 A * 6/1995 Bowen ..... 446/73
D375,427 S * 11/1996 Yeh ..... D21/809
D375,647 S * 11/1996 Delaney ..... D6/589
5,626,503 A * 5/1997 Heftel et al. ..... 446/73
5,638,561 A 6/1997 Sperry et al. ..... 5/485
D429,590 S * 8/2000 Wallace ..... D6/582
6,141,805 A * 11/2000 Fisher-Cohen et al. ..... 5/413 R

* cited by examiner

*Primary Examiner*—Stephen F. Gerrity
(74) *Attorney, Agent, or Firm*—Nawrocki, Rooney & Sivertson, P.A.

(57) ABSTRACT

The present invention is a combination flexible planar item and character. The item comprises a flexible planar item, that when manipulated, takes on the appearance of a character. The character is formed by a character body that becomes defined from the manipulation of the planar item. The planar item has an exterior surface and at least one character feature that is present on the exterior surface of the item. When correctly manipulated, the combination of at least one character feature and the character body provide the appearance of a character.

5 Claims, 10 Drawing Sheets

METHOD OF RECONFIGURING A FLEXIBLE PLANAR ITEM TO A SIMULATED CHARACTER

BACKGROUND OF THE INVENTION

The present invention is generally related to the field of flexible planar items, such as blankets, tarps, banners and the like. In particular, the present invention relates to a flexible planar item that when manipulated, takes on the appearance of a character.

Planar materials are utilized for a variety of items. Some examples of such uses are provided as follows. Planar materials such as blankets have many uses, such as to keep a person or animal warm, or may be used to cover a surface, such as a bed or placing over the ground during a picnic. Another example, is a tarp. Tarps also have many uses such as, for covering items, like a vehicle during a period of non-use. Furthermore, planar materials may be used as banners, signs or other such items.

Typically, when these items are not in use, they are folded or rolled up and placed in storage until they will again be called upon to serve their intended purpose. These items, therefore, have no purpose until they are to be used for their primary purpose.

However, it is possible for these items to have an expanded function, such as to represent a particular sports team, to be a plaything for children, or to act as a token to commemorate an event, etc.

Accordingly, an item should be developed that can provide an expanded function for typical flexible planar items. The present invention addresses these needs, as well as other problems associated with existing flexible planar items.

SUMMARY OF THE INVENTION

The present invention is a combination flexible planar item and character. The item comprises a flexible planar item, that when manipulated, takes on the appearance of a character. The character is formed of a character body that is defined during the manipulation of the planar item and at least one character feature that is oriented on the character body.

The planar item may be any shape such as rectangular and may have fringe along one or more of its edges. The planar item has an exterior surface and the character feature or features are present on the exterior surface of the item.

The feature may be any character feature such as facial features, appendages, articles of clothing, and the like. The feature may be applied to the planar item by means such as embroidery, adhesives, bonding, and the like, or may be provided integral to the planar item.

When correctly manipulated, the combination of at least one character feature and the character body provide the appearance of a character. The manipulation may be accomplished by methods such as folding, rolling, or the combination of folding and rolling. The character body may be any shape, such as a cylinder, and the shape may be maintained by a belt or other such feature. The belt may be provided integral to the planar item or be attached thereto.

One method of creating a combination character from a flexible planar item is comprised of the steps of: providing a flexible planar item having first and second surfaces, at least first, second, and third edges, and having a character feature present on the first surface. The item is then folded and/or rolled to form a character body that has a character feature oriented upon the exterior of the character body.

One embodiment is constructed having four edges with a corner connecting the second and third edges, and at least one character feature placed on the first surface, proximate to the corner.

The folding of the item may be accomplished by a method such as by folding the flexible planar item in half, by orienting the forth edge and a portion of the second surface over itself, to form a folded edge. The item may then be folded again by folding one third of the flexible planar item, from the folded edge, to form two short edges and two long edges.

The item may then be rolled by a method such as by rolling the flexible planar item beginning at the short edge distal to the corner until the entire flexible planar item is rolled, forming a generally cylindrical character body having a character feature oriented upon the exterior of the character body.

The aforementioned benefits and other benefits including specific features of the invention will become clear from the following description by reference to the accompanying drawings.

DETAILED DESCRIPTION OF THE INVENTION

Figure 1:
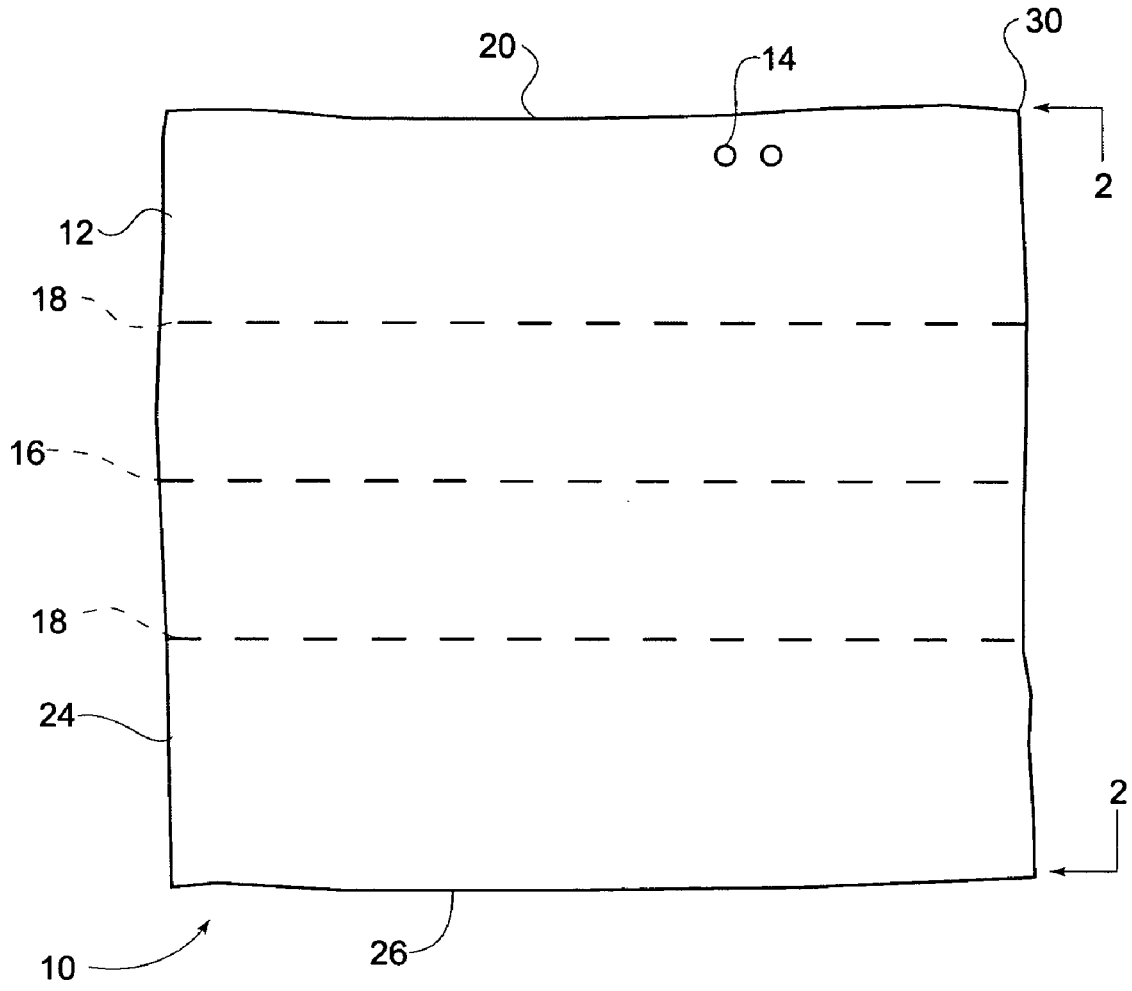
FIG. 1 is an overhead view of a flexible planar item.

Referring now to the drawings wherein like reference numerals denote like elements throughout the several views, FIG. 1 illustrates an overhead view of a flexible planar item 12 according to an embodiment of the present invention. In particular, the combination flexible planar item and character 10, as shown, is comprised of a flexible planar item 12 having a first edge 20, a second edge 22, a third edge 24, a fourth edge 26, a corner 30, and at least one character feature 14.

Figure 8:
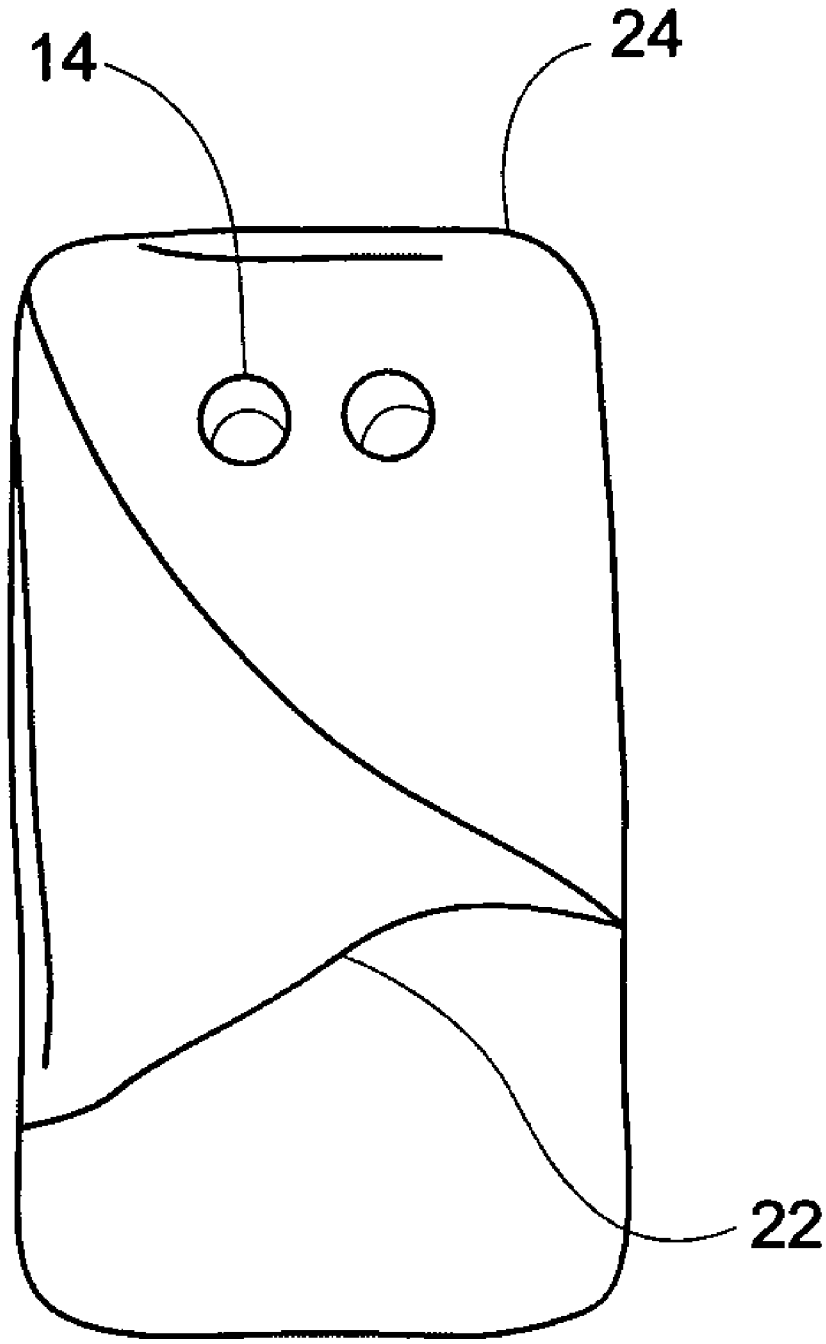
FIG. 8 is a side perspective view of a character of the present invention, manipulated from the planar item of FIG. 1.
Figure 9:
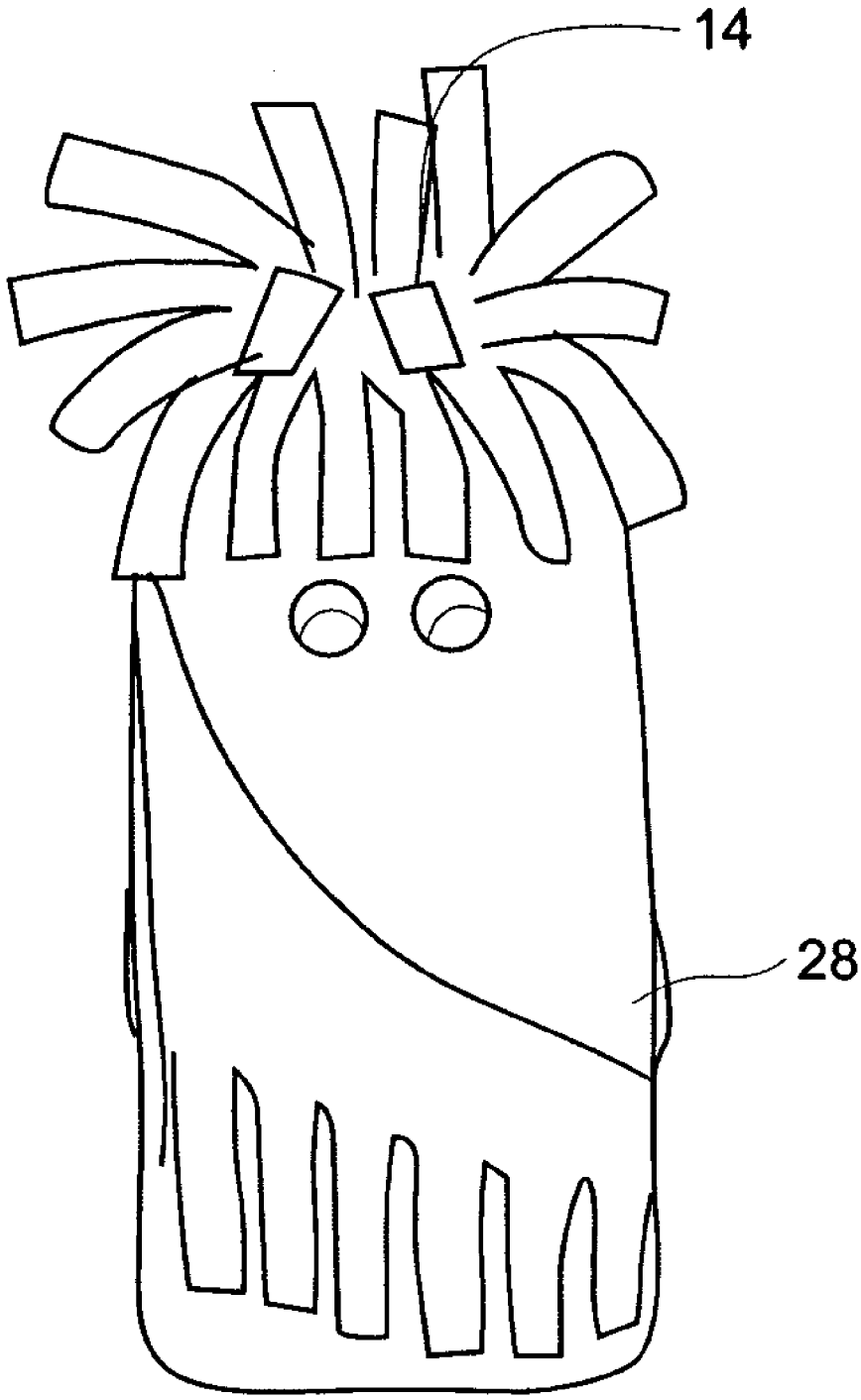
FIG. 9 is an alternative embodiment of the character of the present invention.
Figure 10:
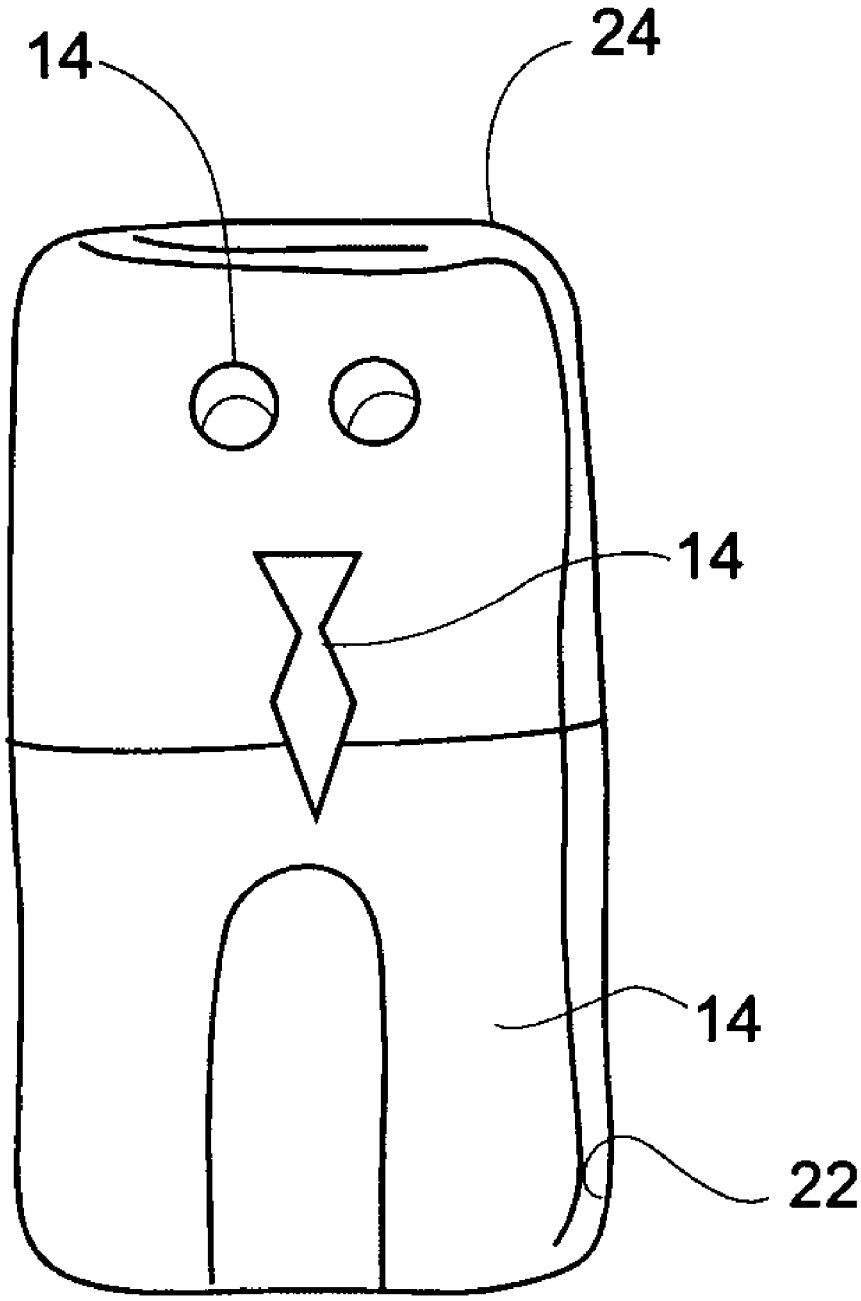
FIG. 10 is another alternative embodiment of the character of the present invention.

Any character feature or combination of features may be utilized to create the appearance of a character. For example, as illustrated in the figures, two character features are present, namely two eyes. The eyes are positioned on the first surface of the flexible planar item 12, such that when the item 12 is manipulated in a predetermined way, the item will take on the appearance of a character. Three such characters are shown in FIGS. 8, 9, and 10. FIG. 10 shows a character having five character features, namely, two facial features (eyes), an article of clothing (tie), and a pair of appendages (legs). Furthermore, the feature or features 14 may be affixed to the item 12 by any manner known in the art. For example, the features may be embroidered into the fabric. Some other common methods of affixation include: snaps, hook and loop fasteners such as Velcro®, rivets, sewing, adhesives, and the like. In another example, one or more of the character features may be bonded to the flexible item through a bonding means either during manufacturing or after the item has been formed. For instance, on products such as fleece, a radio wave bonding process may be utilized. For this method, the character features may be constructed from a material called Lextra® available from FiberLok Products of Fort Collins, Colo. It is also foreseeable that the material comprising the item may be manufactured having the feature either incorporated into or affixed on the material.

The dotted lines 16 and 18 on the drawings represent one set of fold lines for the manipulation of the planar item 12 into a character. Although these fold lines are one method of manipulating an item, the folding and/or rolling of the item and the orientation of the character features may be of any suitable design, so long as the manipulated shape takes on the appearance of a character.

The finished shape of the character may be any suitable shape. For example, as shown in FIGS. 8 and 9, the character shape is generally cylindrical in nature. It is foreseeable that more folds or less folds may be utilized to make the character of the present invention. For example, the item may simply be folded in half and rolled to create an elongate cylinder that forms a character body.

The shape of the character may also be maintained by a means for restraining its shape. Any suitable means known in the art for restraining the shape of the character may be utilized. Some examples of means for restraining the shape of the character include Velcro®, snaps, buttons, loops, and the like.

The means for restraining may also look like an article of clothing worn by the character or an accessory item. Some examples of such items include, belts, necklaces, or scarves; clothing such as hats, coats, shirts, skirts, or pants. As shown in FIG. 9, an accessory, such as a belt 28 may be provided to maintain the shape of the character and to provide an additional character feature.

Additional items may be added that provide further character features. The items can be generic in nature or can be specific in nature to personalize the character. These items could also be designed to restrain the shape of the character. The additional items may be any suitable item known in the art. Some examples of these items include: appendages, accompanying toys, books, sporting equipment, holiday items, work specific items, sleeping bags etc.

The material comprising the planar item may also be shaped to provide a character feature, such as an article of clothing, an appendage, hair, and/or other such features. For example, as shown in FIG. 9, the planar item may have fringe along one or more edges to provide a feature such as hair.

The material used to construct the combination flexible planar item and character may be any suitable material known in the art. The material must be of a generally planar shape when fully expanded and must be capable of manipulation from a planar configuration into a manipulated configuration or from a manipulated configuration into a planar configuration. Some examples of preferred materials include: synthetic and natural fabrics and combinations thereof, flexible plastics, fleece materials, etc.

The method of manipulating the planar item into a character may be accomplished in several ways. The device is preferably manipulated through folding, rolling, or a combination of folding and rolling. The device may begin or end in either the manipulated configuration or the planar configuration.

Figure 2:
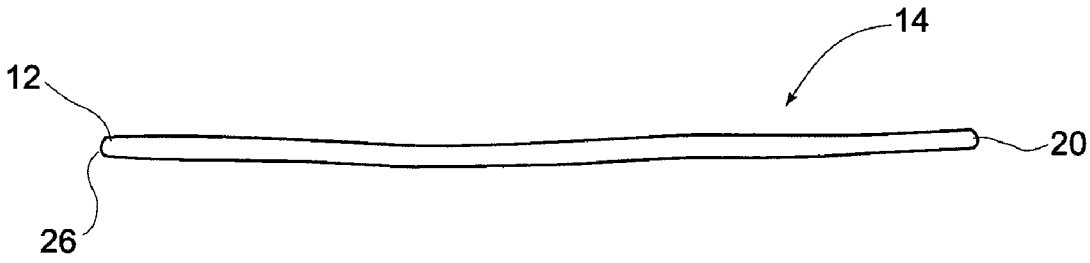
FIG. 2 is side view of the present invention taken along line 2—2 of FIG. 1.
Figure 3:
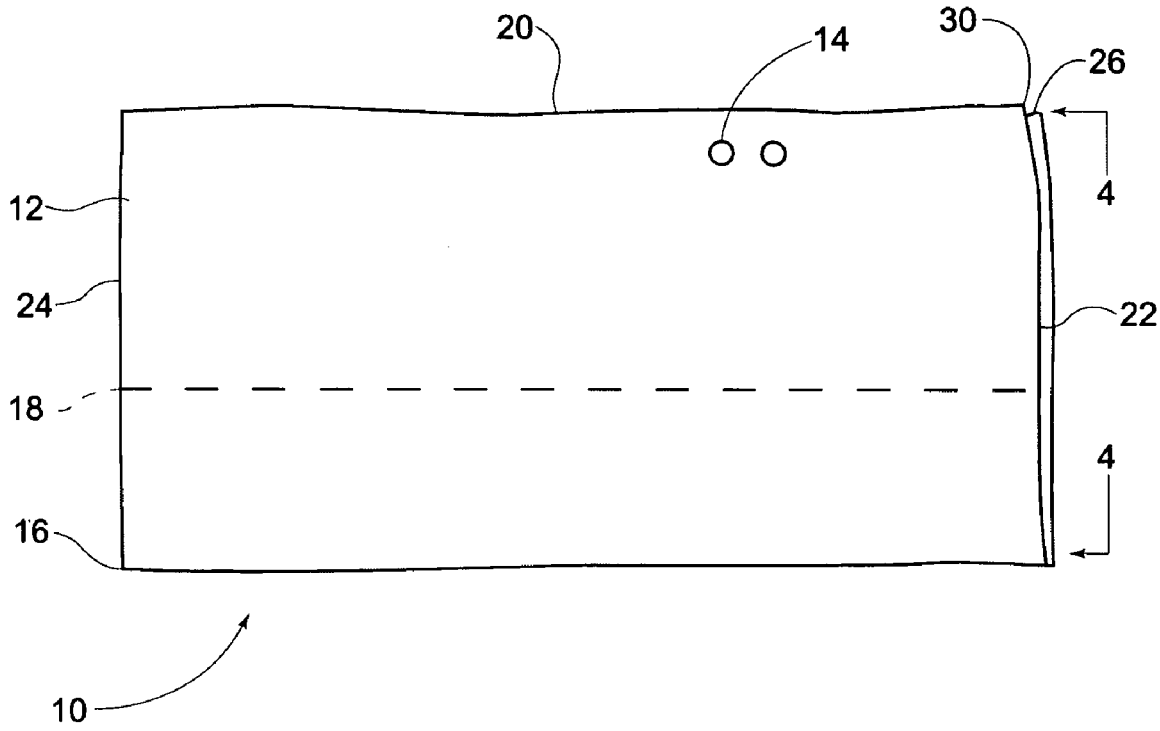
FIG. 3 is an overhead view of the item of FIG. 1 in the process of manipulation into a character body.
Figure 4:
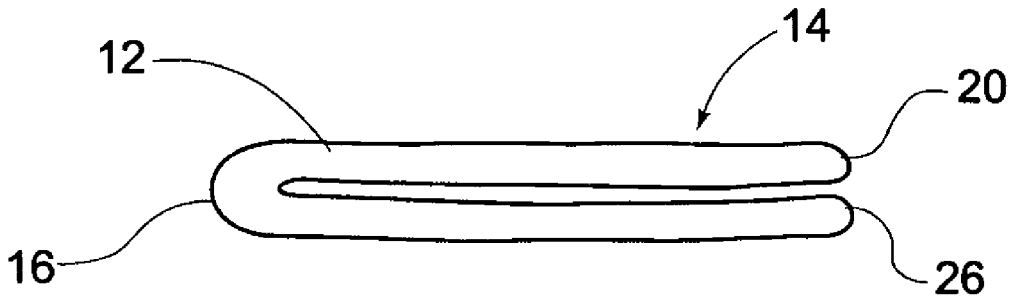
FIG. 4 is a side view of the item as manipulated in FIG. 2 taken along line 4—4 of FIG. 3.
Figure 5:
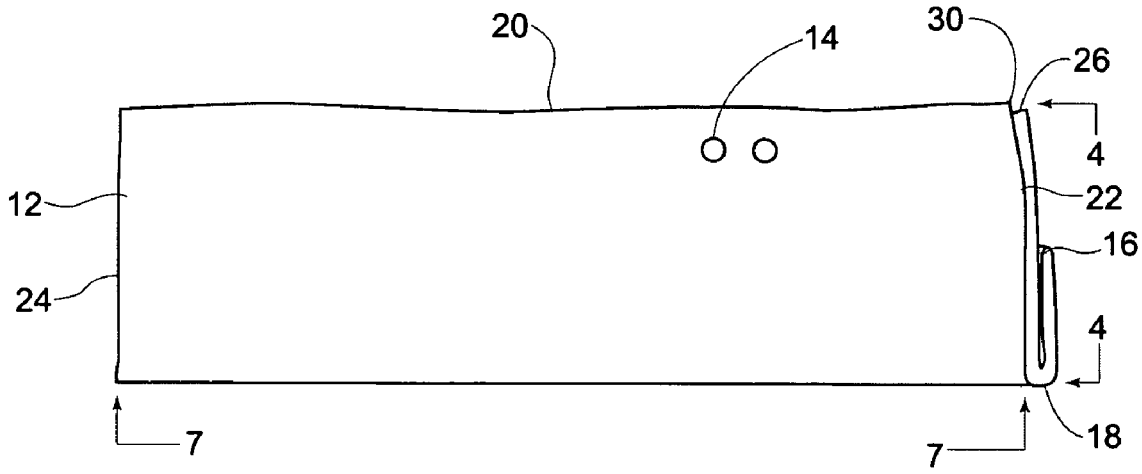
FIG. 5 is an overhead view of the item of FIG. 3 in the process of further manipulation into a character body.
Figure 6:
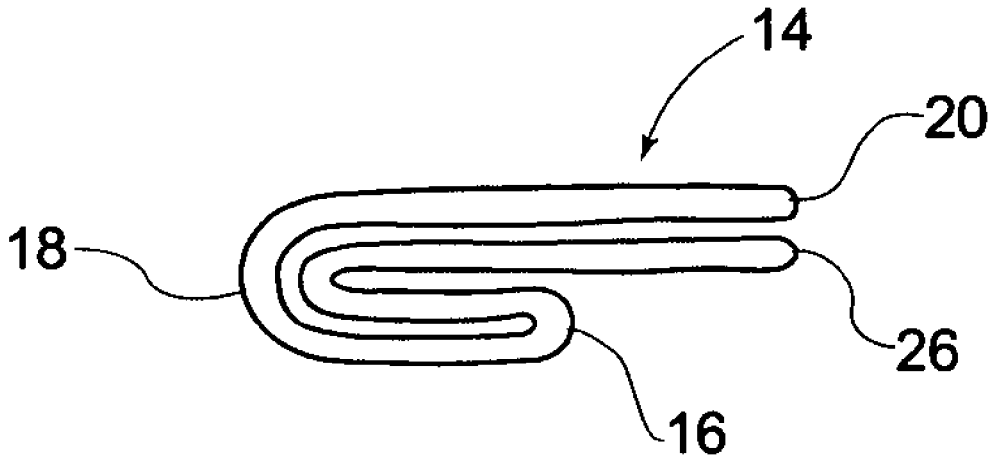
FIG. 6 is a side view of the item as manipulated in FIG. 5 taken along line 6—6 of FIG. 5.
Figure 7:
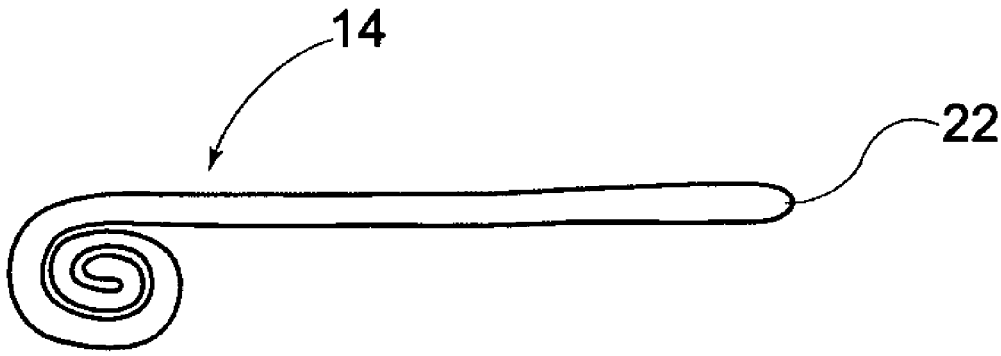
FIG. 7 is a side view of the item of FIG. 5 in the process of further manipulation into a character body.

One method of folding the item is shown in the drawings and is accomplished as follows. The flexible planar item is expanded to its full planar extent, as shown in FIGS. 1 and 2. The planar item is then folded in half by folding the fourth edge 26 toward the third edge 24 such that the second surface is folded over itself. This fold creates a half flexible planar item having a folded edge at line 16. This stage of manipulation is demonstrated in FIGS. 3 and 4.

One third of the half flexible planar item is then folded from the folded edge, to form two short edges and two long edges. The item is then rolled, from the short edge comprised of the first edge 20, toward the short edge comprised of the second edge 22, to form the character body. Once the item 12 is completely rolled, the character body is formed. The character feature 14 is located generally on the exterior surface of the body, meaning that the feature is located either on the exterior surface or alternatively, when the corner 30 of the planar item 12 is folded back, as shown in FIG. 8, the character feature 14 is revealed.

Since many possible embodiments may be made of the present invention without departing from the scope thereof, it is to be understood that all matter herein set forth or shown in the accompanying drawings is to be interpreted in the illustrative and not limiting sense.

What is claimed is:

1. A method of creating a character, said character having a head and a body, comprising the steps of:

providing an item which is flaccid and flexible, said item having at least first, second and third edges, and said item is configurable between first and second configurations and, when in said first configuration, defines a surface which is generally planar;

portraying at a location on the surface, proximate a said first edge thereof, a first feature of said character, and portraying on the surface a second feature of said character; and manipulating the item from said first configuration to said second configuration by overlapping a first portion of the item onto a second portion thereof in a direction toward said first edge and overlapping a third portion of said item onto a fourth portion of said item in a direction generally from the second edge to said third edge, wherein, when the item is in the first configuration, it the item serves a blanket function, and, when it the item is in the second configuration, it the item takes on the appearance of the character by simulating the head and body of the character with the first and second features positioned appropriately with respect to the body to suggest the head of the character.

2. The method of creating a character according to claim 1, wherein said step of providing an item which is flexible and which is configurable includes:

providing an item having first and second surfaces, and wherein at least one of said features is portrayed on said first surface.

3. The method of creating a character according to claim 2, wherein the step of manipulating is accomplished by folding said item.

4. The method of creating a character according to claim 2, wherein the step of manipulating is accomplished by rolling said item.

5. The method of creating a character according to claim 2, wherein the step of manipulating is accomplished by folding and rolling said item.

* * * * *

UNITED STATES PATENT AND TRADEMARK OFFICE

CERTIFICATE OF CORRECTION

PATENT NO. : 7,144,359 B1
APPLICATION NO. : 09/680817
DATED : December 5, 2006
INVENTOR(S) : Mary M. Ponthan et al.

It is certified that error appears in the above-identified patent and that said Letters Patent is hereby corrected as shown below:

In Claim 1, Col. 4, line 47 thereof, after “proximate”, delete “a”.

In Claim 1, Col. 4, line 58 thereof, after “tion,” delete “it”, first occurence; and In Claim 1, Col. 4, line 58 thereof, after “when”, delete “it”, second occurrence.

In Claim 1, Col. 4, line 59 thereof, after “configuration,” delete “it”.

In Claim 2, Col. 4, line 66 thereof, after “and”, delete “which”; and

In Claim 2, Col. 4, line 66 thereof, after “configurable”, add --to define a surface which is generally flat--.

In Claim 2, Col. 5, line 1 thereof, after “surfaces” delete the “,” (comma); and In Claim 2, Col. 5, line 1 thereof, after “and”, second occurrence, add --at least first, second and third edges, and--

Signed and Sealed this

Seventeenth Day of April, 2007

JON W. DUDAS
*Director of the United States Patent and Trademark Office*